US010900744B1

(12) United States Patent
Houck

(10) Patent No.: US 10,900,744 B1
(45) Date of Patent: Jan. 26, 2021

(54) HOLSTER

(71) Applicant: Vista Outdoor Operations LLC, Farmington, UT (US)

(72) Inventor: Larry A. Houck, Louisburg, KS (US)

(73) Assignee: Vista Outdoor Operations LLC, Anoka, MN (US)

( * ) Notice: Subject to any disclaimer, the term of this patent is extended or adjusted under 35 U.S.C. 154(b) by 0 days.

(21) Appl. No.: 16/251,717

(22) Filed: Jan. 18, 2019

(51) Int. Cl.
*F41C 33/02* (2006.01)
*F41C 33/04* (2006.01)
*F21V 23/02* (2006.01)

(52) U.S. Cl.
CPC ..... *F41C 33/041* (2013.01); *F21V 23/023* (2013.01); *F41C 33/0209* (2013.01)

(58) Field of Classification Search
CPC ..... F41C 33/041; F41C 33/0209; F41C 33/0254; F41C 33/0263; F41C 33/02; F41C 33/06; F21V 23/023
USPC ..... 224/243, 192, 193, 238, 242, 198, 911; 42/106
See application file for complete search history.

(56) References Cited

U.S. PATENT DOCUMENTS

| | | | |
|---|---|---|---|
| 1,046,912 | A | 12/1912 | Wanee |
| 1,113,530 | A | 10/1914 | Audley |
| 1,148,935 | A | 8/1915 | Snavely |
| 1,421,578 | A | 7/1922 | Schussler |
| 1,635,984 | A | 7/1927 | Corriston |
| 1,641,439 | A | 9/1927 | Jovino |
| 1,750,139 | A | 3/1930 | Swift |
| 1,851,352 | A | 3/1932 | Denkert |
| 1,951,865 | A | 3/1934 | Franz |

(Continued)

FOREIGN PATENT DOCUMENTS

| | | | |
|---|---|---|---|
| EP | 1975542 | A2 | 10/2008 |
| FR | 2893404 | A1 | 5/2007 |

(Continued)

OTHER PUBLICATIONS

European Patent Office, Search Opinion of Application No. 10828676.6, dated Feb. 16, 2015 3 pages.

(Continued)

*Primary Examiner* — Nathan J Newhouse
*Assistant Examiner* — Lester L Vanterpool
(74) *Attorney, Agent, or Firm* — Reed Smith LLP; Matthew P. Frederick; Cheryl L. Gastineau

(57) ABSTRACT

A combination exteriorly worn holster and an illuminator packaged together for retail sale, the combination providing a simple exteriorly worn holster solution for handguns with an attached accessory that is wearable either on the right or left side, with a reliable passive retention, and with a universal fit for a very large segment of the semi-automatic handguns with accessory rails. The accessory removed from the packaging instantly snaps onto the handgun's rail without utilizing threaded fasteners such that the handgun and accessory is readily received by the holster and the accessory provides the entirety of the engagement between the handgun and accessory combination and the holster. The holster's passive retention comprising a polymer spring unitary with the holster body, wherein the holster body conformingly and snugly engages and grips the accessory as it is holstered retaining the handgun in position by the illuminator.

19 Claims, 9 Drawing Sheets

(56) References Cited

U.S. PATENT DOCUMENTS 2,051,844 A 8/1936 Green
2,088,811 A 8/1937 Ray
2,109,734 A 3/1938 Preneta
2,349,376 A 5/1944 Ray
2,443,397 A 6/1948 Myres
2,551,913 A 5/1951 Toby
2,577,869 A 12/1951 Adams
2,590,187 A * 3/1952 Langos ..... B65D 81/363 224/575
2,893,615 A 7/1959 Couper
3,289,903 A 12/1966 Taormina
3,419,728 A 12/1968 Wilson
3,420,420 A 1/1969 Clark
3,550,821 A 12/1970 Daigle
3,550,822 A 12/1970 Lloyd
3,669,325 A 6/1972 Furman
3,718,240 A 2/1973 Rose
3,777,952 A 12/1973 Theodore
3,804,306 A 4/1974 Azurin
3,828,990 A 8/1974 Baldocchi
3,866,811 A 2/1975 Hamby
3,904,091 A 9/1975 Jones
3,910,469 A * 10/1975 Baldocchi ..... F41C 33/045 224/198
RE30,139 E 11/1979 Jones
4,277,007 A 7/1981 Bianchi et al.
4,846,384 A 7/1989 Perry
5,018,654 A 5/1991 Rogers et al.
5,048,735 A 9/1991 McCormick
5,082,318 A 1/1992 Held et al.
5,094,376 A 3/1992 Baruch
5,100,036 A 3/1992 Rogers et al.
5,127,566 A 7/1992 Beletsky
5,129,562 A 7/1992 Bianchi
5,172,575 A * 12/1992 Fisher ..... E05B 37/20 206/317
5,199,620 A 4/1993 Beletsky
5,215,238 A 6/1993 Baruch
5,275,317 A 1/1994 Rogers et al.
5,282,559 A 2/1994 Aerle et al.
5,284,281 A * 2/1994 Nichols ..... F41C 33/0227 224/193
5,322,200 A 6/1994 Blanchard
5,358,160 A 10/1994 Bianchi
5,372,288 A 12/1994 Rogers et al.
5,395,021 A 3/1995 Brown
5,419,474 A 5/1995 Marx et al.
5,421,497 A 6/1995 Gilmore
5,449,103 A 9/1995 Tilley
5,458,266 A 10/1995 Pichot
5,467,909 A 11/1995 Resca et al.
5,501,380 A 3/1996 Wu
5,501,381 A 3/1996 Rogers et al.
5,509,591 A 4/1996 Carver
5,513,785 A 5/1996 Campagna, Jr.
5,518,155 A * 5/1996 Gallagher ..... F41C 33/04 224/244
5,551,611 A 9/1996 Gilmore
5,570,830 A * 11/1996 Nichols ..... F41C 33/0236 224/193
5,573,157 A 11/1996 Mauriello et al.
5,598,958 A 2/1997 Ryan, III et al.
5,611,164 A 3/1997 Rassias
5,622,295 A 4/1997 Hellweg et al.
5,749,507 A 5/1998 Wood
5,758,448 A * 6/1998 Thummel ..... F41G 1/36 362/114
5,768,816 A 6/1998 Rassias
5,779,114 A 7/1998 Owens
5,806,739 A 9/1998 Wood
5,810,221 A 9/1998 Beletsky et al.
5,810,222 A 9/1998 Shoemaker
5,855,305 A 1/1999 Nichols
5,916,087 A 6/1999 Owens
5,918,784 A 7/1999 Serpa
5,927,578 A 7/1999 Kay
5,931,358 A 8/1999 Rogers
5,944,239 A 8/1999 Rogers et al.
5,961,013 A 10/1999 Collins
6,085,951 A 7/2000 Beletsky et al.
6,112,962 A * 9/2000 Matthews ..... F41C 33/0236 224/191
6,149,042 A 11/2000 Rassias
6,189,751 B1 2/2001 Tserng
6,230,946 B1 5/2001 Vor Keller et al.
6,267,279 B1 * 7/2001 Matthews ..... F41C 33/0236 224/191
6,276,581 B1 8/2001 Glock
6,320,975 B1 11/2001 Vieweg
6,349,496 B1 2/2002 Neely
6,389,726 B1 5/2002 Bentley
6,398,089 B1 6/2002 Har-Shen
6,415,541 B1 7/2002 Rassias
6,467,660 B1 10/2002 Rogers et al.
6,523,374 B1 2/2003 Owens
6,533,149 B2 3/2003 Vor Keller et al.
6,547,111 B2 4/2003 French
6,585,209 B1 7/2003 Mattingly
6,588,635 B2 7/2003 Vor Keller et al.
6,604,657 B2 8/2003 Yirmiyahu et al.
6,616,020 B1 9/2003 Spielberger
6,634,527 B2 10/2003 Lui
6,641,009 B2 11/2003 French et al.
6,732,891 B2 5/2004 Locklear, III
6,752,300 B2 6/2004 Har-Shen
6,755,331 B2 6/2004 Rassias
6,769,581 B2 8/2004 Rogers et al.
6,769,582 B1 8/2004 Beletsky et al.
6,799,392 B2 10/2004 Milec et al.
D501,991 S 2/2005 Cook et al.
6,854,626 B2 2/2005 Liao
6,886,725 B2 5/2005 Lowe et al.
6,918,519 B2 7/2005 Vor Keller et al.
6,948,644 B1 9/2005 Beletsky
D512,561 S 12/2005 Cook et al.
7,117,625 B2 * 10/2006 Pikielny ..... F41C 33/0209 42/90
7,140,523 B2 11/2006 Lowe et al.
7,200,965 B2 4/2007 Vor Keller et al.
7,258,259 B1 8/2007 Owens
7,434,712 B2 * 10/2008 Cook ..... F41C 33/0209 224/193
7,461,765 B2 12/2008 French et al.
7,530,456 B1 5/2009 Tsai
7,543,404 B2 6/2009 Kovalchuk et al.
7,556,181 B2 7/2009 Spielberger
7,562,797 B2 7/2009 Senn et al.
7,584,875 B2 9/2009 Lowe et al.
7,591,402 B2 9/2009 Rassias
7,644,845 B2 * 1/2010 Lowe ..... F41C 33/0245 224/243
7,694,860 B2 4/2010 Clifton, Jr.
7,703,231 B2 * 4/2010 Wei ..... F41G 11/003 42/124
7,735,255 B1 * 6/2010 Kincaid ..... F41C 33/041 42/146
7,762,018 B1 7/2010 Fitzpatrick et al.
7,819,294 B2 10/2010 Lowe et al.
7,841,497 B1 * 11/2010 Gregory ..... F41C 33/045 224/243
7,850,053 B2 12/2010 Rassias
7,922,050 B2 4/2011 Benes
7,934,333 B1 5/2011 Tuz
7,937,880 B1 5/2011 Fidlow
7,950,553 B2 5/2011 Rassias
7,954,971 B1 * 6/2011 Kincaid ..... F41G 1/35 362/110
8,052,018 B2 11/2011 Gallagher
8,096,453 B2 1/2012 Lowe et al.
8,132,355 B1 3/2012 Kincaid et al.
8,141,758 B2 3/2012 Spielberger
8,177,108 B1 5/2012 Kincaid et al.

(56) References Cited

U.S. PATENT DOCUMENTS 8,215,525 B2 7/2012 Rassias
8,235,263 B1 8/2012 Yeates et al.
8,251,266 B2 8/2012 Gregory et al.
8,281,512 B2 10/2012 Lara
8,302,827 B1 11/2012 Cole
8,371,487 B1 2/2013 Plappert
8,474,670 B1 * 7/2013 Gregory ..... F41C 33/045 224/243
RE44,428 E 8/2013 Spielberger
8,517,235 B1 8/2013 Kincaid et al.
8,544,706 B2 10/2013 Crye
8,602,275 B1 12/2013 Kiger et al.
8,602,276 B2 12/2013 Tyybakinoja
8,631,981 B2 1/2014 Zusman
8,646,665 B2 2/2014 Abushaev
8,690,032 B2 * 4/2014 Baumann ..... F41C 33/0263 224/243
8,714,423 B1 5/2014 Kincaid et al.
8,720,753 B2 5/2014 Benes
8,720,754 B2 5/2014 Kirsch
8,720,755 B2 5/2014 Gregory et al.
8,783,532 B2 7/2014 Gregory et al.
8,807,404 B1 8/2014 Howell et al.
8,851,344 B2 10/2014 Baumann et al.
8,870,042 B2 10/2014 Clifton
8,910,839 B2 12/2014 Clifton
8,925,773 B2 1/2015 Clifton
D723,796 S 3/2015 Resca
8,985,412 B2 3/2015 Rorick et al.
9,016,533 B2 4/2015 Visalli et al.
9,022,262 B2 5/2015 Pellegrini
9,057,579 B2 6/2015 Rorick et al.
9,057,580 B2 * 6/2015 Rorick ..... F41C 33/0254
9,086,254 B1 7/2015 Plappert
9,109,855 B1 8/2015 Kincel
9,134,093 B2 9/2015 Yeates
D740,021 S 10/2015 Faifer
9,175,925 B2 11/2015 Pellegrini
9,228,802 B2 1/2016 Ribas
9,459,064 B1 * 10/2016 Xu ..... F41A 17/54
9,541,349 B2 * 1/2017 Benton ..... F41C 33/04
9,759,515 B2 9/2017 Yeates
9,777,986 B1 * 10/2017 Lance ..... F41C 33/0263
9,797,680 B2 * 10/2017 Hyde ..... F41C 33/06
10,024,615 B1 7/2018 Oh et al.
2004/0050887 A1 3/2004 Spielberger
2004/0195282 A1 10/2004 Beletsky et al.
2005/0205621 A1 * 9/2005 Shults ..... F41G 11/003 224/198
2005/0205624 A1 9/2005 French et al.
2005/0279789 A1 12/2005 Lowe
2006/0011187 A1 * 1/2006 Gardner, Jr. ..... F41A 9/53 124/73
2006/0156525 A1 7/2006 Jenkins et al.
2006/0157520 A1 7/2006 Clifton, Jr.
2006/0175366 A1 8/2006 Dekaise
2006/0226185 A1 10/2006 Har-Shen
2007/0181619 A1 * 8/2007 Seyfert ..... F41C 33/04 224/196
2008/0110947 A1 5/2008 Pikielny
2008/0121670 A1 5/2008 Buress
2008/0148619 A1 * 6/2008 Rogers ..... F41G 1/35 42/90
2008/0179359 A1 7/2008 Aberle et al.
2008/0179360 A1 * 7/2008 Lowe ..... F41C 33/0263 224/243
2009/0321480 A1 12/2009 Kincaid et al.
2010/0276464 A1 11/2010 Hirt et al.
2011/0011904 A1 1/2011 Schultz et al.
2011/0101063 A1 5/2011 Zusman
2011/0163138 A1 7/2011 Tybakinoja
2011/0174849 A1 7/2011 Clifton, Jr.
2011/0174850 A1 7/2011 Clifton, Jr.
2013/0240582 A1 9/2013 Tyybakinoja et al.
2014/0048572 A1 * 2/2014 Yeates ..... F41C 33/0272 224/193
2014/0109345 A1 4/2014 Melville
2015/0168099 A1 * 6/2015 Hyde ..... F41C 33/06 206/317
2015/0285587 A1 10/2015 Abushaev
2016/0069639 A1 * 3/2016 Yeates ..... F41C 33/0263 224/243
2016/0123700 A1 * 5/2016 Manglos ..... F42B 39/02 150/112
2017/0003101 A1 1/2017 Madrid et al.
2017/0023324 A1 * 1/2017 Xu ..... F41A 17/54
2017/0205189 A1 * 7/2017 Rogers ..... F41C 23/12
2018/0058812 A1 * 3/2018 Gilbert ..... F41C 33/041
2018/0224230 A1 * 8/2018 Myers ..... F41J 5/10
2018/0274281 A1 * 9/2018 Bernkrant ..... E05B 39/005
2018/0321014 A1 * 11/2018 Rassias ..... F41C 33/0263

FOREIGN PATENT DOCUMENTS

WO WO2010/064268 6/2010
WO WO2013/071402 5/2013
WO WO2014/028876 2/2014
ZA 986778 2/1999

OTHER PUBLICATIONS

European Patent Office, Supplementary Search Report of Application No. 10828676.6, dated Feb. 16, 2015 2 pages.
Written Opinion of the International Searching Authority for International Application No. PCT/US2010/002935 dated Jan. 7, 2011.
PCT International Preliminary Report on Patentability for International Application No. PCT/US2010/002935 dated May 15, 2012 5 pages.
PCT International Search Report for International Application No. PCT/US2010/002935 dated Jan. 7, 2011, 2 pages.

* cited by examiner

HOLSTER

BACKGROUND OF THE DISCLOSURE

Consumers at all levels need or desire holsters for their handguns. Generally such holsters need to provide adequate retention and where they are to be worn exterior to the body are generally formed of rigid polymers and are form fit to specific handguns. Although what is "adequate" retention varies with the user, in most exteriorly worn rigid polymer holsters, the adequate retention is provided by finger actuated retention mechanisms. Passive retention holsters, particularly those formed or rigid polymers, typically utilize adjustable retention mechanisms with threaded fasteners for adjusting the handgun retention. Such mechanisms typically consist of the fastener pulling opposing sides of the holster together at the holster trigger guard. Such a holster configuration will require many holsters to accommodate the many differently sized and configured available handguns.

Military personnel and law enforcement have needs for holsters with at least two levels, sometimes three levels, of handgun retention, including at least one active level of retention with an active finger operated mechanical release mechanism. Such users further require a high degree of reliability and an extended useful life under daily use conditions. Such complexity increases costs of such holsters. Most polymer rigid holsters that form fit handguns need to be designed for particular models of handguns, resulting in a different holster for each different handgun design and a vast number of different models and SKU's for a particular style holster. The holster manufacturer will generally need to have a separate mold for each holster body, again increasing the costs of such holsters. Moreover, due to the finger actuated retention mechanisms, the holster bodies are not interchangeable for left handed and right handed users, further increasing the number of molds. Holster retailers need a substantial amount of space to both display and stock the vast array of holsters. This essentially precludes retailers that have limited space from adding holsters to their store inventory, such as big box discount retailers with smaller sporting goods departments. These retailers demand quick product turnover to justify the space taken up by the product. Also, it is difficult and time consuming for the consumer to locate and find the right holster for their particular handgun or handguns when facing multiple products at the retail store.

A very large percentage of handguns being sold have accessory rails that will support accessories such as laser sights and illuminators. Illuminators may be either flash lights or infrared light generators. Providing holsters for the handguns that have such an attached accessory on the rail has been challenging for the holster industry and solutions would be well received.

SUMMARY

A combination exteriorly worn holster and an illuminator or laser sight accessory is packaged together for retail sale, the combination providing a simple exteriorly worn holster solution for handguns with attached accessory wearable either on the right or left side and with a reliable passive retention and with a universal fit for a very large segment of the semi-automatic handguns having accessory rails that are being commercially sold. In embodiments, the accessory instantly snaps onto the handgun's rail without tightening threaded fasteners such that the holster is readily received by the handgun and the accessory provides the entirety of the engagement between handgun/accessory combination and the holster. Moreover, the holster's passive retention comprises a polymer spring unitary with the holster body, wherein the spring engages and grips the accessory retaining the handgun.

The inventor has recognized that although certain retailers that do not focus on shooting sports would like to stock holsters for handguns, however the vast array of different holsters for different handguns, precludes any limited sized display. These retailers need a holster product that needs minimal shelf or display area, and that has characteristics presenting a potential for a high volume inventory turnover. Embodiments herein allow for a single SKU, or very minimal number of SKUs, for such holsters requiring minimal space at the retail level, both for display and stocking, allowing retailers that do not have expansive space for holsters to now display and stock a single holster product, or very few holster products, that will accommodate a high percentage of their handgun owning customers. Retail products in accord with embodiments herein have the added bonus of a displaying and included a desirable accessory with a holster to boost sales, the holster/accessory combination having the desirable feature that the accessory may be retained on the handgun during holstered, in fact, the accessory providing the engagement with the holster and the accessory facilitating the universality nature of the holster. Thus, not only providing for the retailer a great space saving benefit, but also providing an expectation of high volume sales.

Accessories for handguns, such as target illuminators and laser sighting devices have become popular for all levels of consumers of handguns. Handguns often have standardized rails for supporting such accessories. The vast majority of holsters are not configured to accommodate the handgun with accessory and the accessory needs to be removed before holstering. Such accessories, as well as different handguns with rails, have a large number of different form factors. Providing form fit holsters that accommodate different rail mounted accessories, specifically laser sights and illuminators, is problematic due to the vast number of combinations of handgun and accessory configurations.

Currently, form fitting holsters for handguns with rail mounted illuminators and laser sights have limited available for only popular handguns and a limited number of specific accessories. It remains challenging for the consumer to quickly locate and find the right holster and suitable rail mounted accessory for their particular handgun or handguns at a retail store, and particularly for a lower price point.

A partial solution to the issues of providing holsters accommodating multiple forms of handguns and multiple forms of rail mounted illuminators or laser sights is provided by U.S. Pat. No. 8,690,032. That patent discloses an intermediate engagement member that mounts to the handgun rail and also the accessory, the holster keys on the intermediate engagement member for operating an active retention member and for precise positioning during handgun holstering and while the handgun is in the holster. This patent also discloses that the holster body being form fit to the handgun which will require a number of different holster bodies for different handguns. Additionally the patent discloses that the holster body is form fit to a specifically configured illuminator. Attachment of the intermediate member with screws to the handgun and the attachment of the intermediate member to the accessory with screws provides multiple steps and complexity for the attachment and use of this system. Additionally, the complexity added by the release mechanism and the need for different molds for left and right handed users would keep holsters of the disclosed design at least moderately expensive and require several or more SKUs.

Another partial solution is U.S. Pat. No. 9,777,986, owned by the owner of this application. This patent utilizes a thumb actuated active retention mechanism on the holster that acts on an attached accessory clamped to the handgun rail, the accessory being clamped to the handgun rail with screws. The holster conformingly receiving the accessory. This patent allows the use of different handguns with the accessory as a gap is provided between the handgun and holster body but, the holster still requires different holster bodies for right and left handed users. Thus, due to the needed extra molds, at least for left and right handed users, and the complexity of retention mechanisms, manufacturing cost and the retail price point are still moderately expensive. Such pricing may be too high for some consumers and higher than non-sporting goods, non-firearm dealers would prefer to have in their retail stores.

The inventors have recognized that existing holsters that key on components attached to handgun rails have a loose fit with the component as the component and attached holster are received, and the component and attached handgun being secured in the holster by a mechanism with a blocking portion that interferes with a withdrawal motion. The blocking portion needing to be actively moved by the user actuating a manual release mechanism. Thus, insertion of the accessory and handgun into the holster is loose, not fully constrained, can be audible, and the seating of the component has a noticeable and audible click. Providing a smoother and more constrained and quieter component with accessory insertion into the holster would be well received and appreciated by users.

The applicant has recognized that a particular segment of consumers buying holsters do not want to spend time matching their handgun to rail mounted accessories, and searching for a suitable holster. They do not need or want to pay for holsters with complex retention devices. They want simplicity and easy of attachment of accessories and ease of use. They want simple choices that can be quickly made. They want great value and low cost.

Moreover, the inventor has surmised that handgun owners that have not purchased accessories due to the difficulty of holstering handguns with such accessories. The embodiments herein allow such handgun owners to instantly solve this problem with the purchase of a packaged universal holster and illuminator, benefitting both the customer and retailer.

The inventor has recognized that a product that allows a retailer to offer a holster that accommodates a laser sight and/or a illuminator with multiple handguns and packaging therewith the illuminator or laser sight accessory, at a low price point, requiring absolute minimal shelf or rack space, would be well received by the retail industry, particularly discount retail stores, as well as consumers. Previously the retailer with minimal shelf space, minimal stocking space, and/or high volume sales per display square footage, is essentially precluded from selling holsters.

The inventor has recognized that a single holster product that accommodates a flashlight or laser sight and that is usable by both left and right handed users would be well received by retail stores and consumers. A product that allows a simple attachment of an illuminator to a handgun and an assured fit of the handgun and accessory to a holster would be well received by such retailers and consumers. Such a product that has a low manufacturing cost and minimal components would be well received by the holster industry, and such a product with a low price point would also be well received by the retail industry and consumers. A product that has adequate retention for most users of a handgun with a rail mounted illuminator or laser sight with simplicity and a low cost would be well received by consumers and the retail industry. Embodiments herein provide all of these features and advantages.

Generally, a packaged product that is visually appealing, plainly displays a universal holster usable with a vast number of different handguns, that is usable for left and right handed users, that has graphics setting forth such a capability on the packaging, and that has included a universal quick attaching illuminator or laser sight, visible to the customer as packaged, would be well received by the retail industry and consumers.

In embodiments, a retail holster product comprises a packaged holster and rail mountable accessory comprising an illuminator, the holster product comprises a holster body with only passive retention means, the holster body having attachment openings on each of two opposing sides allowing mounting of a belt loop either side making the holster suitable for left or right handed users. In embodiments, the only assembly is attachment of the illuminator to the handgun rail without using threaded fasteners, insertion of a battery into the illuminator, and attachment of the belt loop directly to one or the other side of the holster body. The attachment using one or more threaded fasteners that secure the belt loop directly to the holster body. The insertion and withdrawal of the handgun and illuminator made without a discrete actuation step of a retention mechanism.

In embodiments, the holster body is injection molded of glass filled polyamide material, the accessory, the illuminator or laser sight, formed of a metal, the portion of the holster body that receives the holster body having an interference fit with the accessory. The glass filled polyamide holster body providing a smooth, soft feel, quiet, and snug engagement with the accessory attached to the handgun. Additionally, in embodiments, the seating of the accessory and attached handgun is quiet and soft in feel. In embodiments, the interference fit is created at least primarily by a unitary spring portion of the holster body defined by slits in the holster body, the spring portion moving outwardly as the holster body receives the accessory and attached handgun.

A feature and advantage of embodiments is that the insertion of the accessory and attached handgun into the holster is smooth, fully constrained in lateral directions, is quiet, and the seating of the component is a motion stop without noise. Providing a smoother and more constrained and quieter component with accessory insertion into the holster would be well received and appreciated by users.

In embodiments, a retail holster product comprises a combination handgun holster and illuminator packaged together for retail sale. In embodiments, the combination includes a holster for receiving a handgun, an illuminator detachably fixable to a mounting rail of the handgun, and packaging suitable for display and sale in a department store environment. In embodiments, the holster comprises a holster body and a belt loop, the holster body and belt loop being disposed in the interior of the package. In embodiments, the holster body has a rearward portion having a shape that is symmetrical about a central plane so that the belt loop is attachable to either a left side or a right side of the holster body and so that the holster is wearable either on the right or left side of a user. In embodiments, the holster body defines a cavity extending forwardly along a handgun receiving and withdrawal axis A. In embodiments, the holster body has a first body portion defining a first cavity portion and a second body portion defining a second cavity portion. In embodiments, the first cavity portion is dimensioned and configured so that, while the handgun is holstered, the first body portion encloses the handgun while leaving a predetermined clearance around the handgun. In embodiments, the predetermined clearance is selected to allow a single holster system to be utilized with a multiplicity of semi-automatic handguns with mounting rails. In embodiments, the second cavity portion has a shape conforming to the shape of the illuminator whereby the second cavity portion receives the illuminator and engagement with the second body portion precludes movement of the illuminator except for movement in the insertion and withdrawal direction along a forward rearward axis of the handgun. In embodiments, the second body portion has a pair of parallel slits defining a leaf spring or a cantilevered spring. In embodiments, the leaf spring or cantilevered spring has a protruding portion extending into the second cavity portion for resiliently engaging the illuminator when the handgun and illuminator are holstered. In embodiments, the packaging is configured such that the holster body and illuminator are visible through the packaging or is graphically portrayed on the packaging.

A feature and advantage of embodiments is a handgun holstering system including an accessory and a holster made almost entirely of polymeric material, except for fasteners. This arrangement provides ease of assembly and cost efficiencies by minimizing the number of parts and minimizing the number of assembly steps.

A feature and advantage of embodiments is an exteriorly worn holster with only passive retention, the passive retention provided by a retention member configured as a polymer spring defined by two parallel slots in the holster body. The spring can be configured as a leaf spring with each of two ends unitary with the holster body or a cantilever spring with one end unitary with the holster body and the opposite end free standing. The slots and spring generally extending parallel to an insertion withdrawal axis. The leaf spring positioned to engage the illuminator or laser sight that is attached to the handgun. In embodiments the leaf spring is on one of two lateral sides of the holster body. In embodiments there may be two mirror image springs for engaging each side of the accessory.

A feature and advantage of embodiments is a handgun holstering system including a holster body integrally formed from a single piece of thermoplastic material. This arrangement allows the holster body to be fabricated using an automated and efficient thermoplastic injection molding process.

A feature and benefit of embodiments includes providing a universal holster system that allows a single holster to be utilized with various makes and models of handgun. In these embodiments, a weapon mounted accessory, such as flashlight, may be used as the sole or primary interface with the holster. The holster partially encloses the handgun while leaving a clearance around the handgun. In embodiments, the clearance around the handgun allows a single holster system to be utilized with various makes and models of handguns.

A feature and benefit of embodiments is a holstering system with no active retention system. In embodiments, the holster system operates more smoothly and more quietly with less wear and tear on the handgun and the holster thereby potentially extending the useful life of the holster.

A feature and advantage of embodiments is a handgun holstering system with a holster body having a unitary retention portion configures as a leaf spring portion for passively retaining a handgun. In embodiments, the leaf spring portion is molded as part of the holster body. In embodiments, the holster body and the leaf spring portion are formed of a single piece of thermoplastic material.

A feature and benefit of embodiments involves reducing or eliminating wear and tear on handgun surface finishes due to the fact that the holster cavity leaves clearance around the handgun, the retention engagement of the holster being with the accessory not the handgun. A feature and benefit of embodiments is a passive retention mechanism that resists withdrawal of the handgun and the accessory attached to the handgun, and that is automatically reset after withdrawal of the handgun. In embodiments, the passive retention mechanism applies forces to the accessory.

A feature and benefit of embodiments is a passive retention mechanism comprising a spring portion and an inwardly protruding portion. In embodiments, the inward protruding portion includes a sloped surface configured to cause outward deflection of the spring portion upon insertion of the handgun/accessory combination into the holster.

A feature and benefit of embodiments is that the holster body defines a cavity that is capable of accepting handguns having different widths, lengths and shapes with an rail mounted attached accessory. A feature and benefit of embodiments is that the holster body is shaped and dimensioned such that the holster body is readily manufactured using a thermal injection molding process.

In embodiments, a retail holster product comprises a combination handgun holster and illuminator packaged together for retail sale. In embodiments, the combination includes a holster for receiving a handgun, an illuminator detachably fixable to a mounting rail of the handgun, and packaging suitable for display and sale in a department store environment. In embodiments, the packaging has an interior for receiving the holster body, a belt loop, and an illuminator. In embodiments, the packaging includes a transparent portion for displaying at least the holster body and the illuminator. In embodiments, the holster comprises a holster body defining a cavity extending forwardly along a handgun receiving and withdrawal axis. In embodiments, the holster body comprises a plurality of side wall portions unitarily formed of a polymeric material. In embodiments, the plurality of side wall portions including a pair of side wall portions joined at a top and bottom of the side wall portions. In embodiments, each side wall portion supports one of a pair of inwardly projecting ribs configured for capturing and engaging the illuminator when the handgun with illuminator is inserted into the holster. In embodiments, the holster and illuminator engagement constrain all freedom of motion of the illuminator except freedom of motion in the insertion and withdrawal direction along a forward rearward axis of the handgun. In embodiments, the illuminator has an illuminating portion and a rail attachment portion. In embodiments, the rail attachment portion defines a first lateral channel on a first side of the illuminator and a second lateral channel on an opposite side of the illuminator for engaging the inwardly projecting ribs of the holster. In embodiments, the ribs are adapted and dimensioned to capture and engage the illuminator when the handgun with illuminator is inserted into the holster.

A combination handgun holster and illuminator packaged together for retail sale is disclosed, in embodiments the combination comprises a holster for receiving a handgun, an illuminator detachably fixable to the handgun, packaging suitable for display and sale in a department store environment. In embodiments, the holster comprises a holster body and a belt loop, the holster body and belt loop being disposed in the interior of a packaging. In embodiments, the holster body has left and right symmetrical rearward portions so that the belt loop is attachable to either the left side or the right side of the holster body and so that the holster is wearable either on the right or left side of a user. The holster body may define a cavity extending forwardly along a handgun receiving and withdrawal axis. In embodiments, the holster body has a first body portion defining a first cavity portion and a second body portion defining a second cavity portion, the first cavity portion being dimensioned and configured so that, while the handgun is holstered, the first body portion encloses the handgun while leaving a clearance around the handgun, the first body portion sized to provide a clearance for a multiplicity of semi-automatic handguns with mounting rails received therein. The second cavity portion has a shape conforming to the shape of the illuminator whereby the second cavity portion receives the illuminator as the handgun is holstered and the holster being fixed to the illuminator the second body portion precludes movement of the illuminator except for movement in the insertion and withdrawal direction along a forward rearward axis of the handgun. In embodiments, the second body portion has a pair of parallel slits defining a cantilever beam spring or leaf spring. In embodiments, the beam or leaf spring has a protruding portion extending into the second cavity portion for resiliently engaging the illuminator when the handgun and illuminator are holstered. In embodiments, the packaging comprises a six sided package having an interior with a volume of about 90 cu. in. to about 104 cu. in, the package having a front panel, a top panel, a bottom panel, a rearward panel, and a pair of lateral panels. In embodiments, the package has graphics on at least on an exposed front panel and the pair of lateral panels, the forward panel defining an opening. In embodiments, the package defines an opening and has a transparent sheet material spanning the opening. In embodiments, the holster body and illuminator are visible through the transparent sheet material.

A combination handgun holster and illuminator packaged together for retail sale is disclosed. In embodiments, the combination comprises a holster for receiving a handgun, an illuminator detachably fixable to the handgun, and packaging suitable for display and sale in a department store environment. In embodiments, the packaging has an interior for receiving the holster body, the illuminator, and a belt loop. In embodiments, the packaging has a transparent portion for displaying at least the holster body and the illuminator. In embodiments, the holster is disposed in the interior of the packaging. In embodiments, the holster comprises a holster body defining a cavity extending forwardly along a handgun receiving and withdrawal axis. In embodiments, the holster body comprises a plurality of wall portions unitarily formed of a polymeric material. In embodiments, the plurality of wall portions including a pair of side wall portions joined at a top and bottom of the side wall portions. In embodiments, each side wall portion supports one of a pair of inwardly projecting ribs configured for capturing and engaging the illuminator when the handgun with illuminator is inserted into the holster. In embodiments, the illuminator has an illumination portion and a rail attachment portion. In embodiments, the rail attachment portion of the illuminator defines a first lateral channel on a first side of the illuminator and a second lateral channel on an opposite side of the illuminator for engaging a pair of inwardly projecting ribs of the holster, the ribs capturing and engaging the illuminator when the handgun with illuminator is inserted into the holster. In embodiments, the holster and illuminator engagement constrains all freedom of motion of the illuminator, and thus the handgun, except freedom of motion in the insertion and withdrawal direction along a forward rearward axis of the handgun.

A holster system for receiving and releasably retaining differently configured handguns is disclosed. In embodiments, each of the differently configured handgun has a mounting rail positioned below a barrel thereof and a predetermined accessory attached to the rail. In embodiments, the accessory is an illuminator with a rail clamp portion with a spring loaded clamp member for quickly securing the accessory to the handgun rail. A holster body of the holster system may comprise a pair of opposing side wall portions defining an interior with an open rearward end, the holster body having a handgun receiving and withdrawal axis extending forwardly and rearwardly. In embodiments, the holster body further has a pair of opposing ribs extending linearly forwardly and backwardly and projecting inwardly from each of the opposing side wall portions. In embodiments, the ribs are spaced from an upwardly facing bottom surface of the holster body a distance for capturing the accessory. In embodiments, the pair of opposing side walls and the ribs define a lower accessory receiving pocket or cavity in the interior.

An advantage of embodiments allow consumers to purchase a holster and handgun accessory without spending time matching their handgun to rail mounted accessories, and searching for a suitable holster, such purchase may be quickly made. Embodiments allow customers to purchase a holster for a handgun and accessory without paying for complex retention devices. Embodiments herein provide simplicity of choice and easy of attachment of accessories and ease of use after the purchase. Embodiments herein can provide to the customer great value and low cost.

A feature and advantage of embodiments is optimal simplicity is provided in selection of a holster product, optimal simplicity in the selection of an illuminator product, optimal simplicity in the assembly of the holster, ultimate simplicity in the attachment of the illuminator to the user's handgun, and optimal simplicity in the use of the holster with the user's handgun and attached illuminator.

The above summary is not intended to describe each illustrated embodiment or every implementation of the present disclosure.

BRIEF DESCRIPTION OF THE DRAWINGS

The drawings included in the present application are incorporated into, and form part of, the specification. They illustrate embodiments of the present disclosure and, along with the description, serve to explain the principles of the disclosure. The drawings are only illustrative of certain embodiments and do not limit the disclosure.

Figure 1:
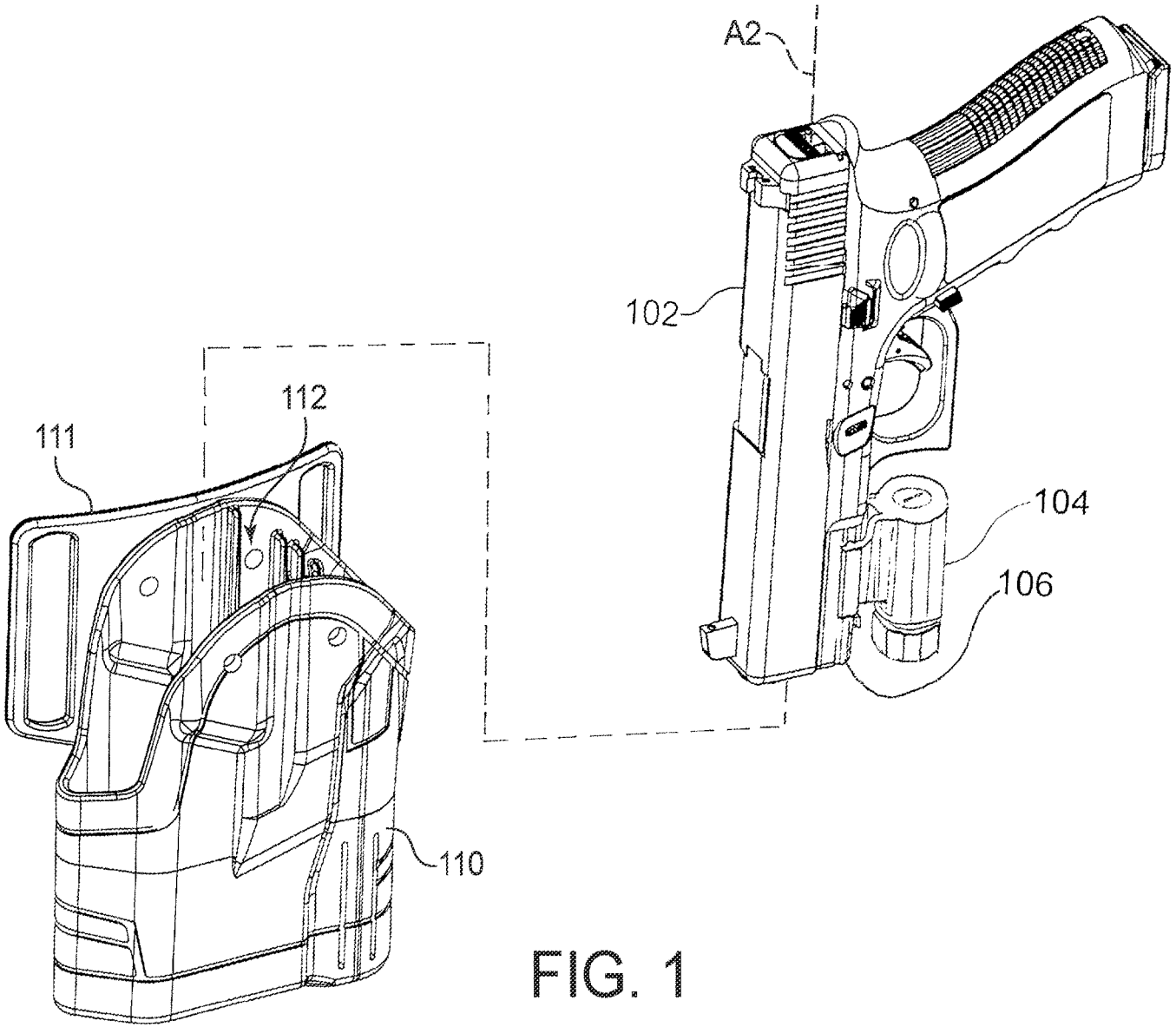
FIG. 1 is a perspective view showing a handgun and a holster.

While embodiments of the disclosure are amenable to various modifications and alternative forms, specifics thereof have been shown by way of example in the drawings and will be described in detail. It should be understood, however, that the intention is not to limit the disclosure to the particular embodiments described. On the contrary, the intention is to cover all modifications, equivalents, and alternatives falling within the spirit and scope of the disclosure.

DETAILED DESCRIPTION

Referring to FIG. 1, a holster 100 receives a handgun 102 with an accessory 104 configured as an illuminator attached to the mounting rail 106 of the handgun. The holster comprising a holster body 110 and a belt loop 111, the holster body defining a cavity 112 for receiving the handgun with the attached accessory.

Figure 2B:
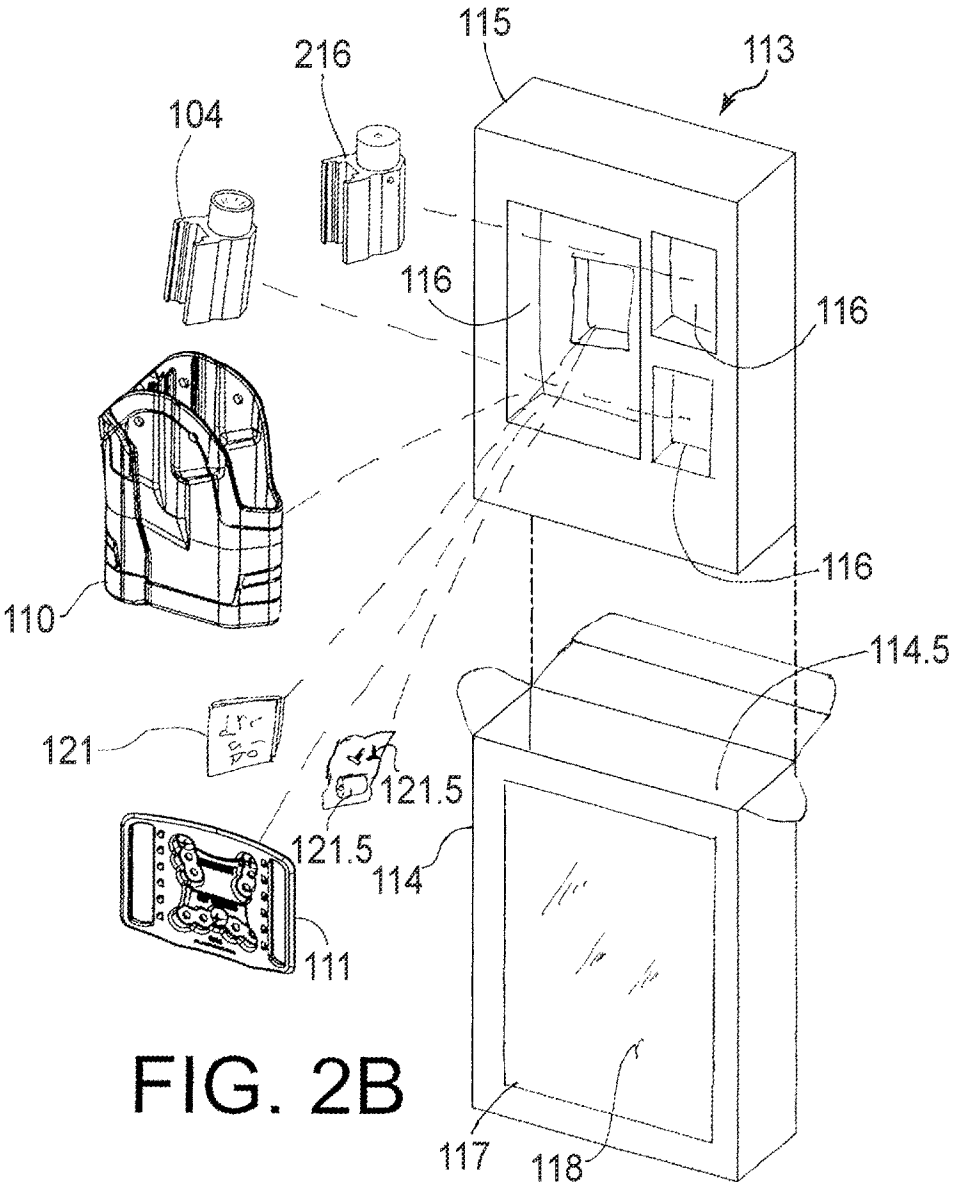
FIG. 2B a exploded view of packaging of a combination holster and two accessories.
Figure 2A:
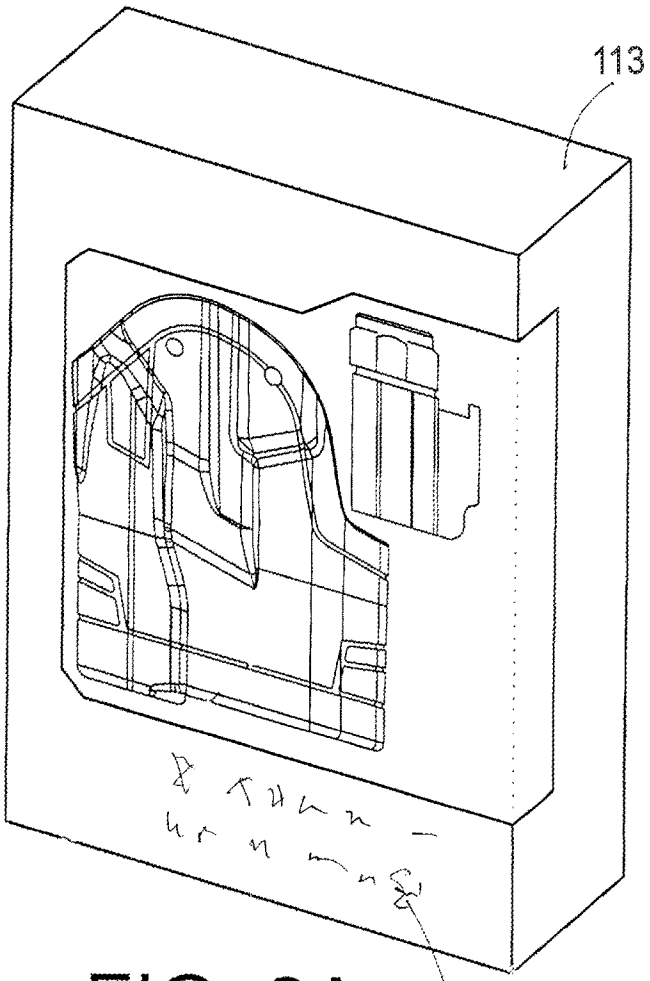
FIG. 2A is a packaged combination holster and accessory according to embodiments.
Figure 2C:
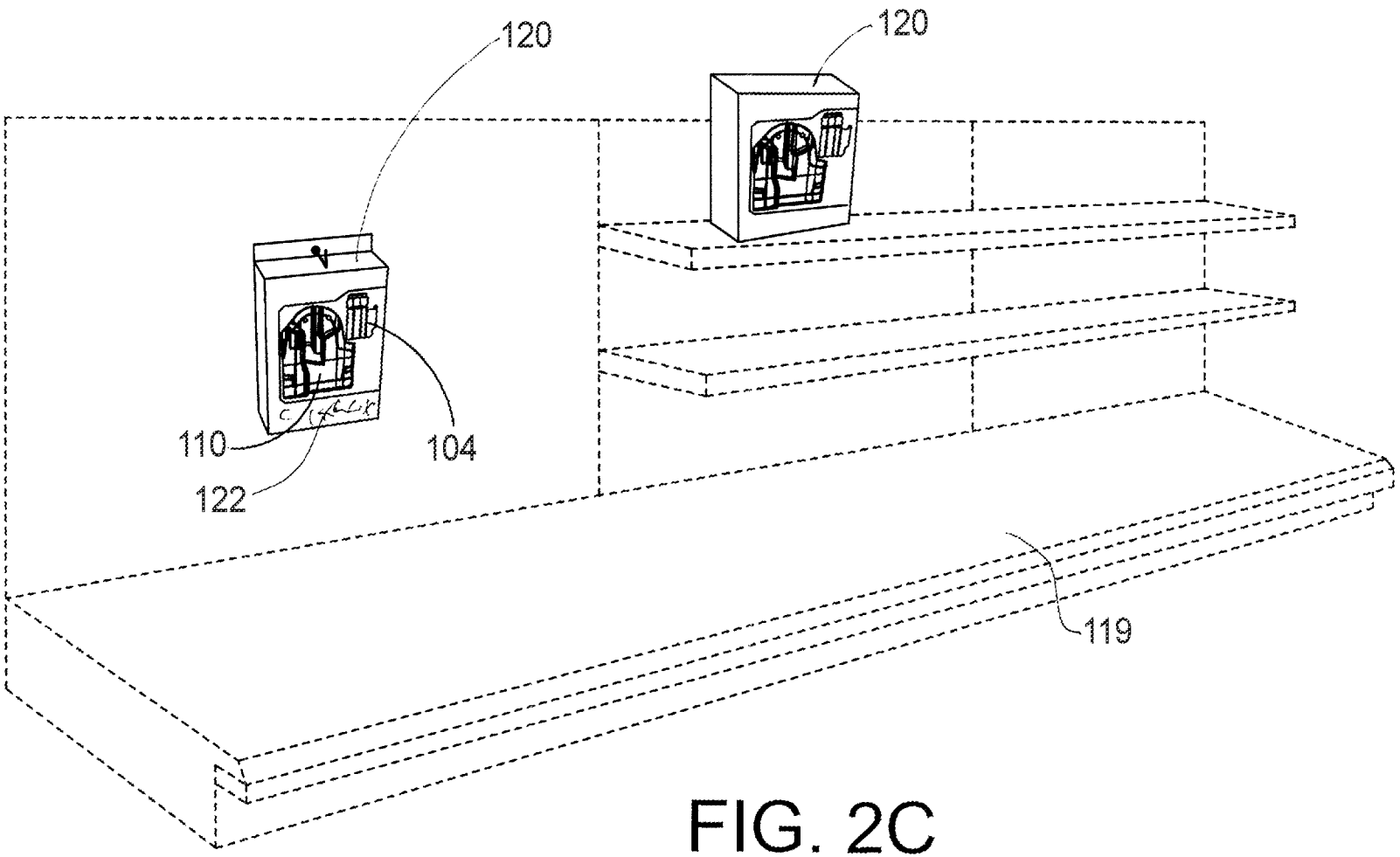
FIG. 2C is a retail display illustrating the minimal display area taken by embodiments.
Figure 3A:
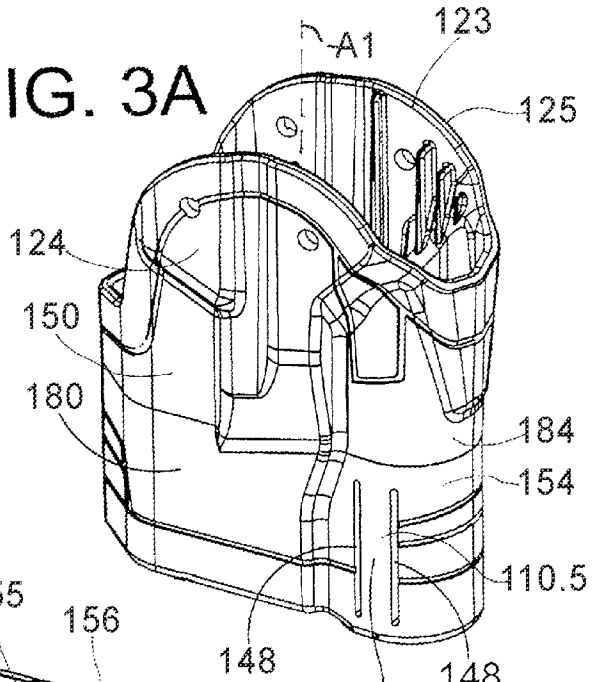
FIG. 3A is a perspective view of a holster body.
Figure 3B:
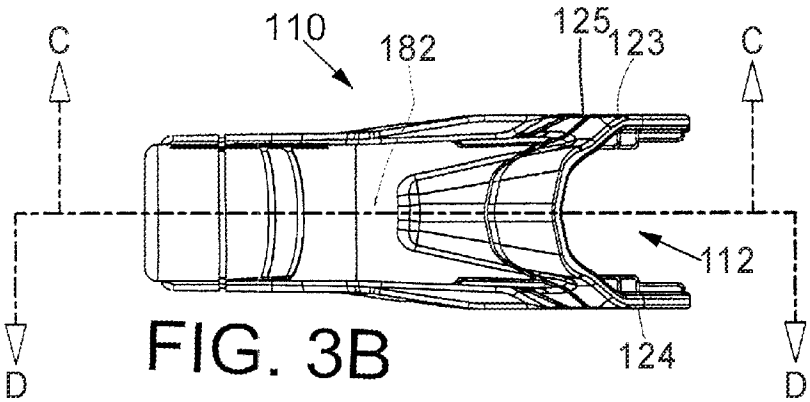
FIG. 3B is a plan view of a holster body.
Figure 3D:
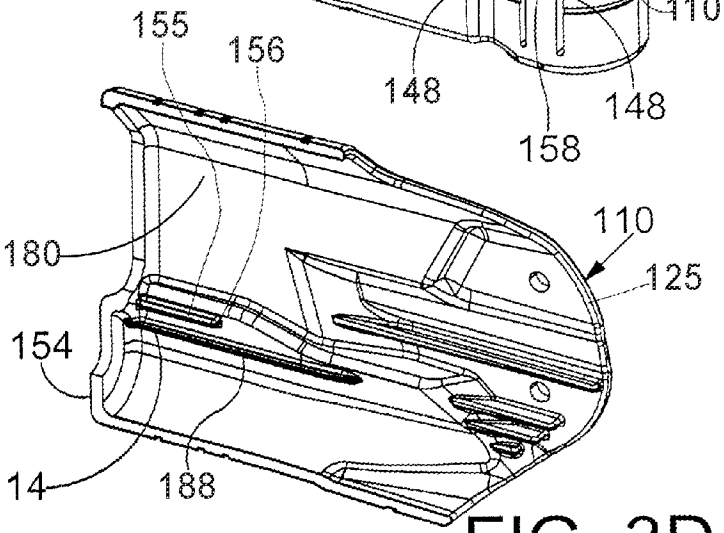
FIG. 3D is a cross-sectional perspective view of the holster body shown in FIGS. 3A and 3B taken at line D-D of FIG. 3B.
Figure 3C:
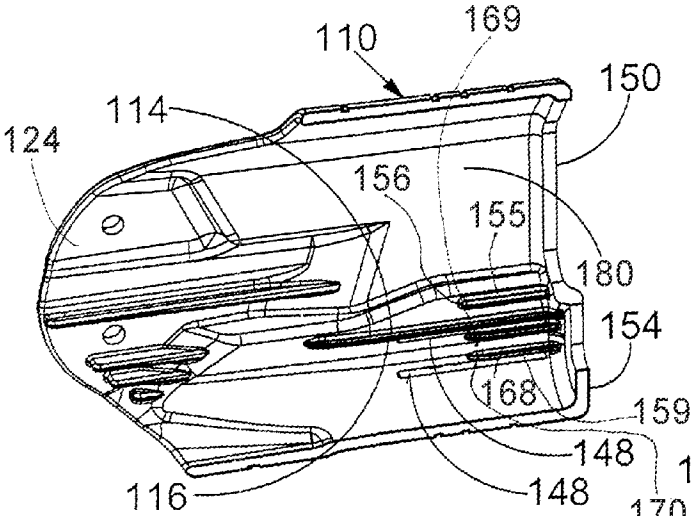
FIG. 3C is a cross-sectional perspective view of the holster body shown in FIGS. 3A and 3B taken at line C-C of FIG. 3B.
Figure 4B:
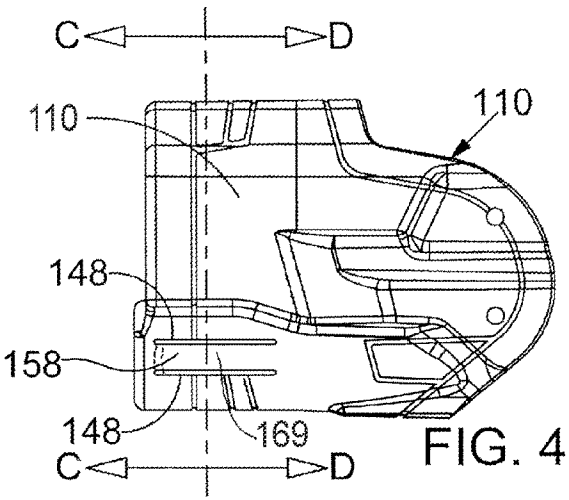
FIG. 4B is a side view of the holster body shown in FIG. 4A.
Figure 4D:
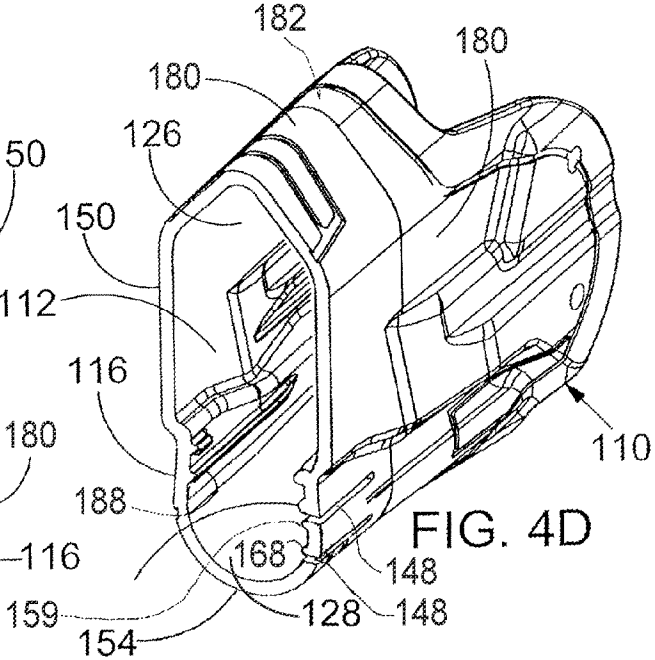
FIG. 4D is a cross-sectional perspective view of the holster body shown in FIG. 4A and FIG. 4B taken at plane C-C of FIG. 4A.
Figure 4A:
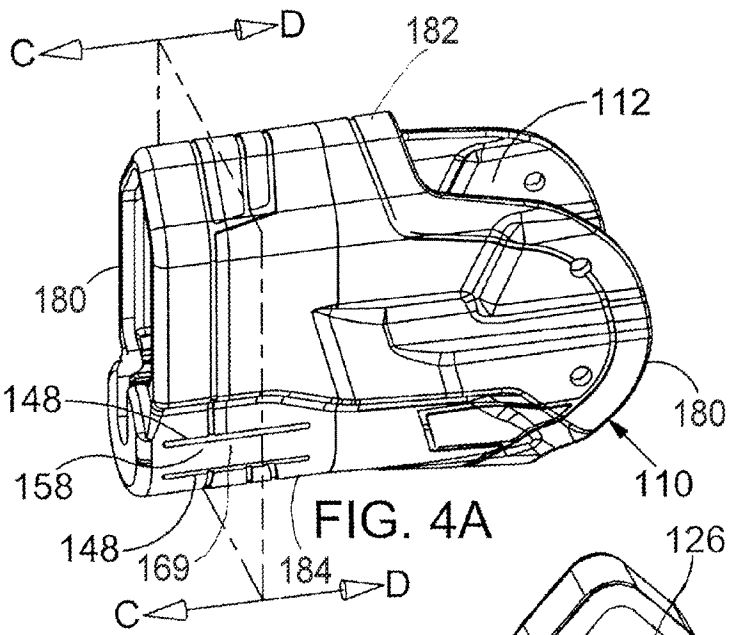
FIG. 4A is a perspective view of the holster body of FIG. 3A.
Figure 4C:
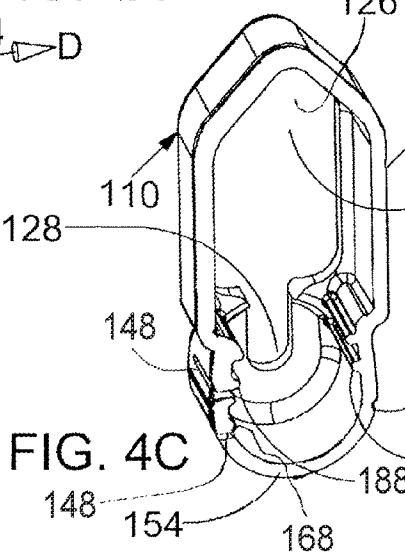
FIG. 4C is a cross-sectional perspective view of the holster body shown in FIG. 4A and FIG. 4B taken at plane C-C of FIG. 4A.

Referring to FIGS. 2A-2C, a combination holster 100 and accessory 104 are packaged together in packaging 113 for retail sale. The packaging can include a box 114, a form 115 with pockets 116 to receive the combination components. The box may have an opening 117 with a transparent polymer material 118 traversing the opening. In embodiments, the combination includes a holster 100 for receiving a handgun 102, an illuminator 104, such as a flashlight, detachably fixable to a mounting rail 106 of the handgun 102, and packaging 113 suitable for display and sale in a retail store environment. The packaged contents may include paper instructions 121 for using the combination, a battery 121.5 or batteries for powering the accessories, and threaded fasteners 121.7 for attachment of the belt loop to the holster. The box 114 may have an interior 114.5 that has a volume of from 90 cu. In. to about 104 cu. in. Referring specifically to FIG. 2C a retail display rack 119 is illustrated in which the packaged combination 120 is shown to take up relatively little display space. This singular packaged combination with the features described herein can be utilized for a multiplicity of handguns having accessory rails. To provide conventional holsters for the same multiplicity of handguns could well take up the entire display rack 119. Graphics 122 on the packaging 113 identifying that the two products therein, the holster and the accessory, will fit the multiplicity of popular handguns, as well as showing the holster 100 and the accessory 104, through the packaging is believed to create very favorable buying atmosphere conducive to high product turnover. Additionally the graphics can inform the potential purchaser that the holster therein may be used both by left and right handed shooters.

Figure 6:
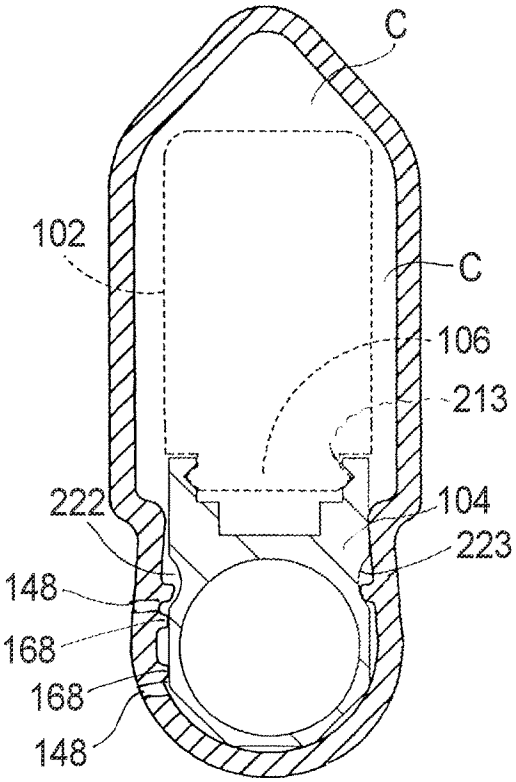
FIG. 6 is a cross-sectional view showing a handgun and an accessory attached to the handgun. In the embodiment of FIG. 6, the handgun and the accessory are received in a holster.
Figure 5C:
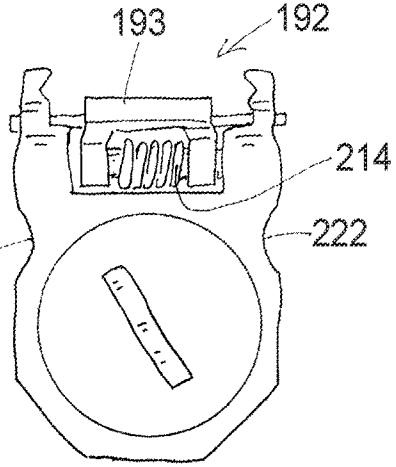
FIG. 5C is an end view of the accessory shown in FIG. 5A, opposite that of FIG. 5B.
Figure 5D:
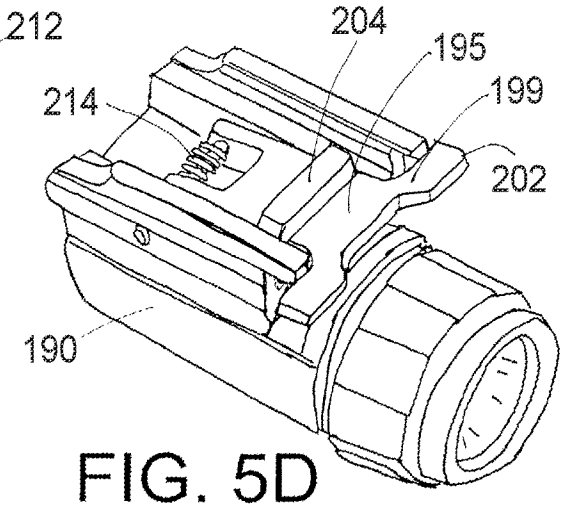
FIG. 5D is a perspective view of the accessory showing a snap-on attachment feature.
Figure 5A:
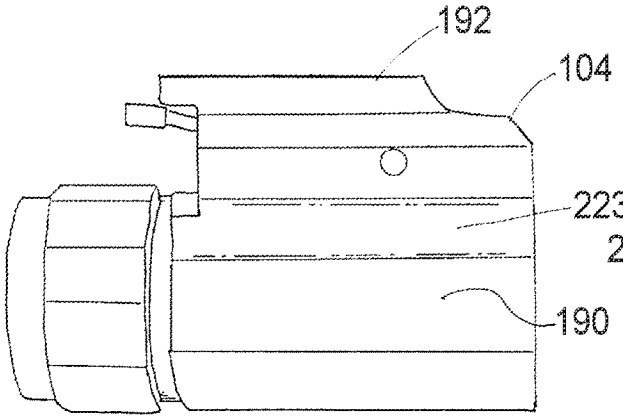
FIG. 5A is a side view of an accessory configured as an illuminator.
Figure 5B:
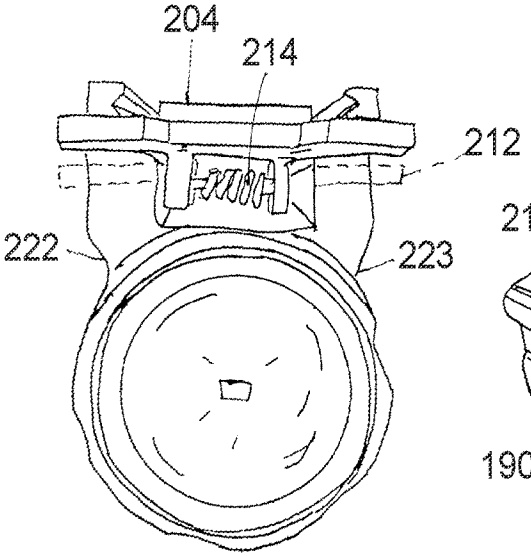
FIG. 5B is an end view of the accessory shown in FIG. 5A.
Figure 7A:
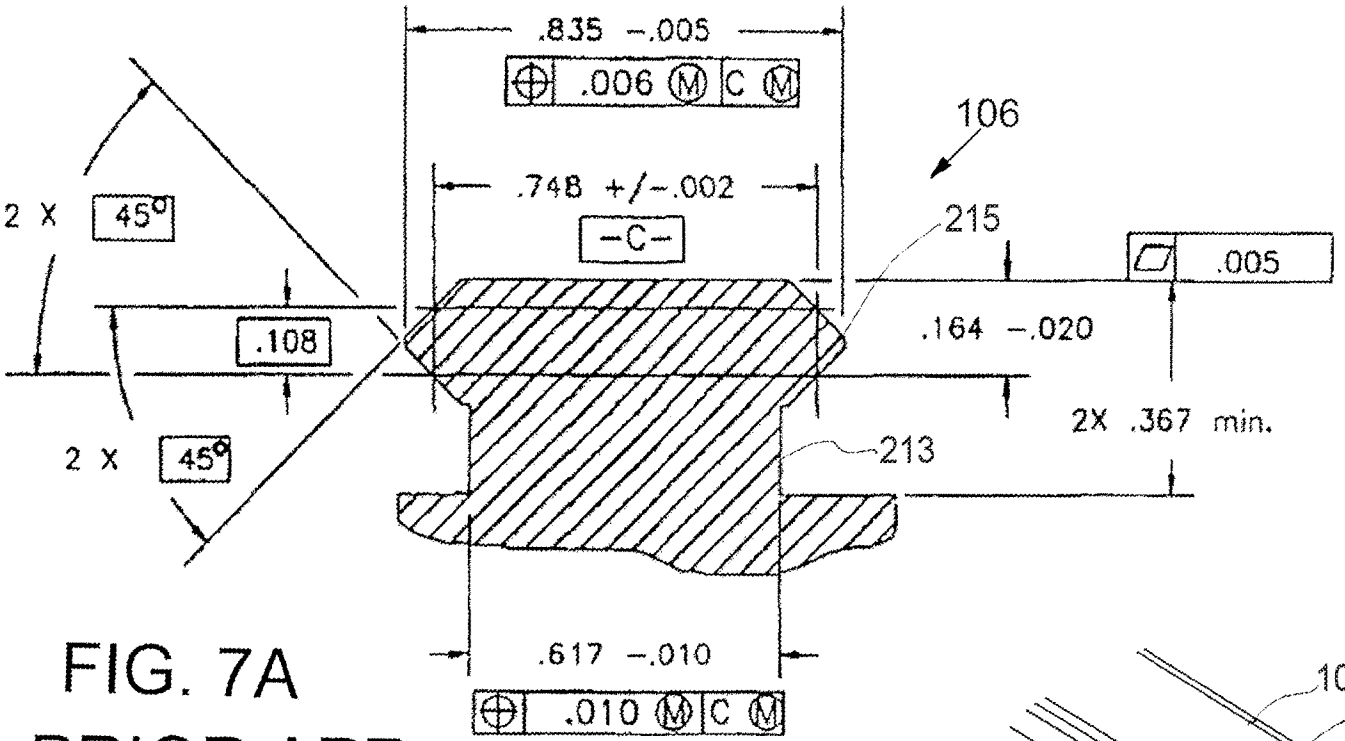
FIG. 7A PRIOR ART
FIG. 7A is a cross-sectional view showing a PRIOR ART standardized mounting rail.
Figure 7B:
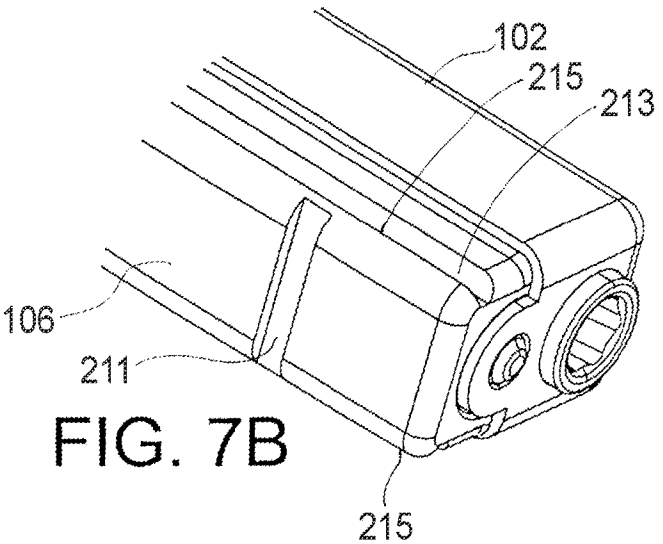
FIG. 7B is a perspective view of a PRIOR ART barrel end of a handgun having an accessory rail with a transverse notch.
Figure 8A:
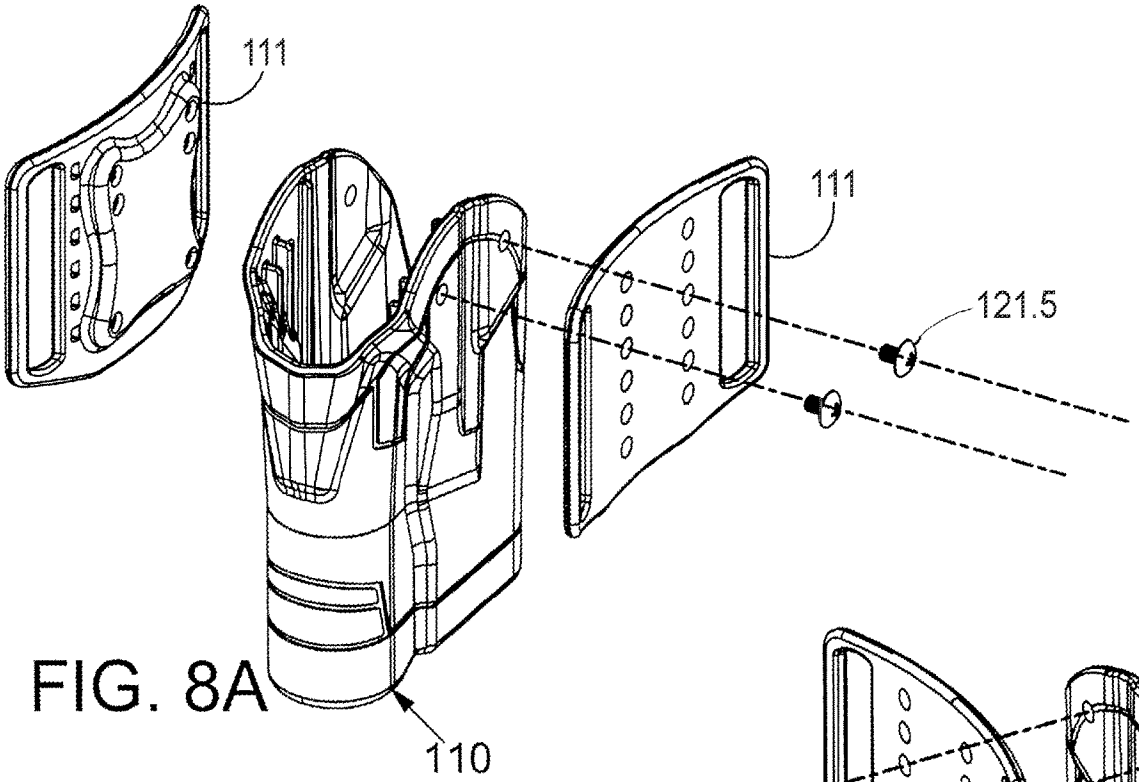
FIG. 8A is an exploded perspective view showing a holster body and a belt loop.
Figure 8B:
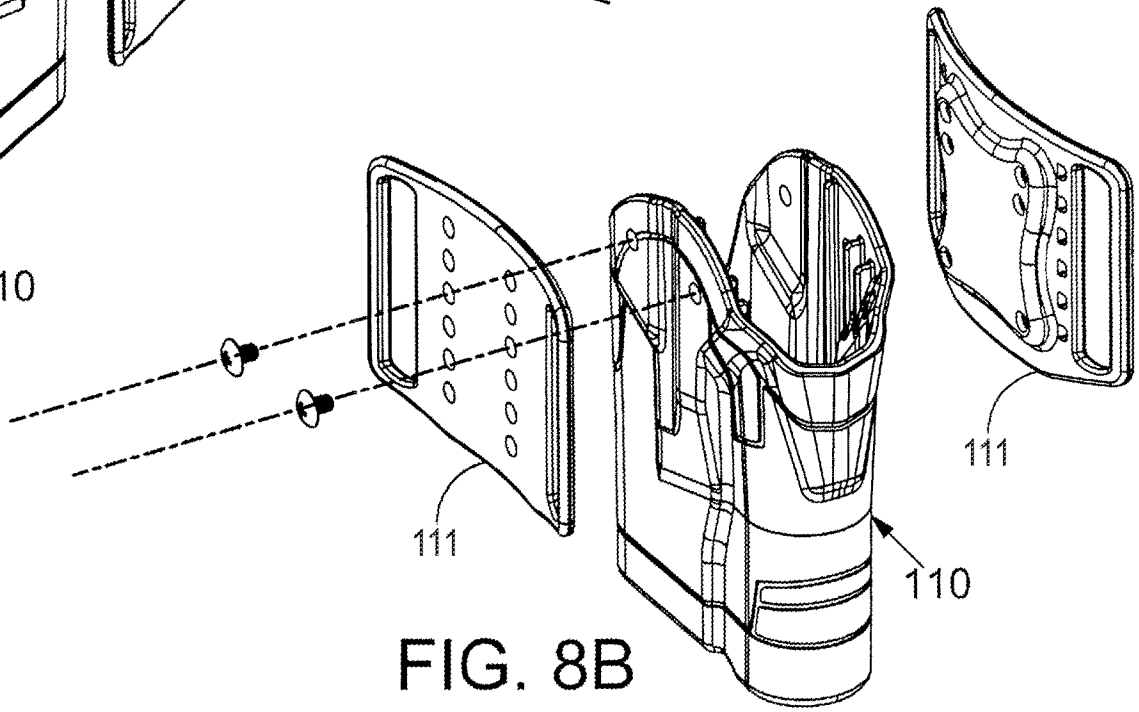
FIG. 8B is an exploded perspective view showing a holster body and a belt loop.
Figure 10:
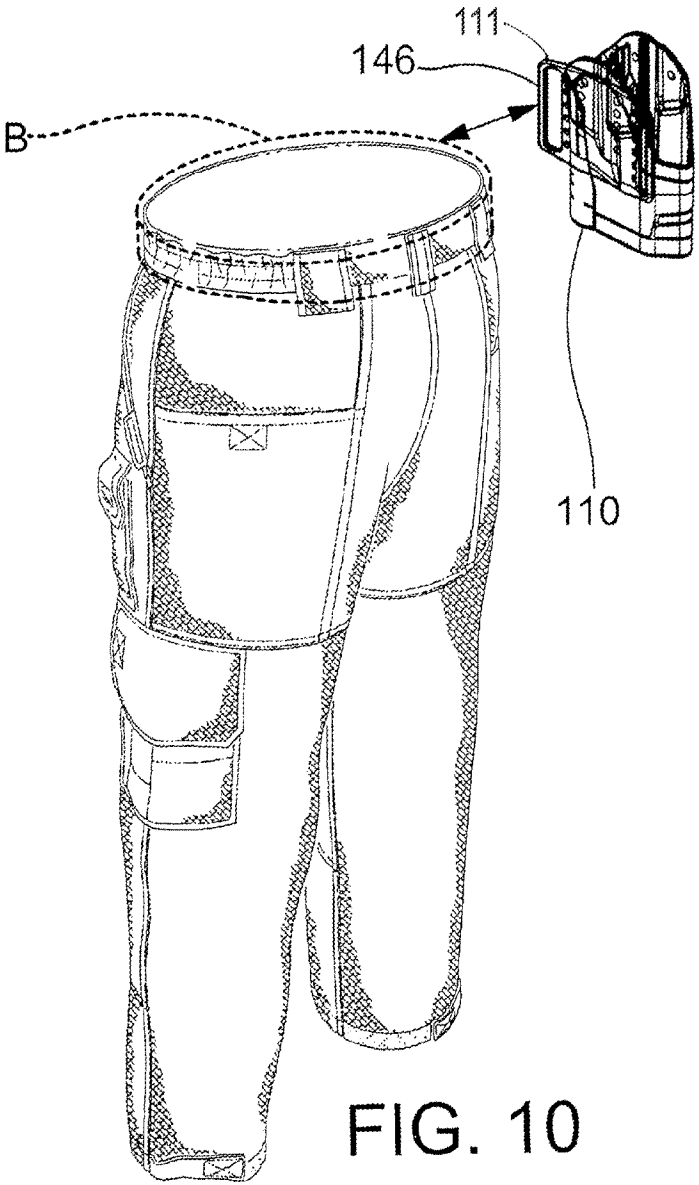
FIG. 10 is a perspective view showing a holster attachable to a user's belt at the user's right side.
Figure 9:
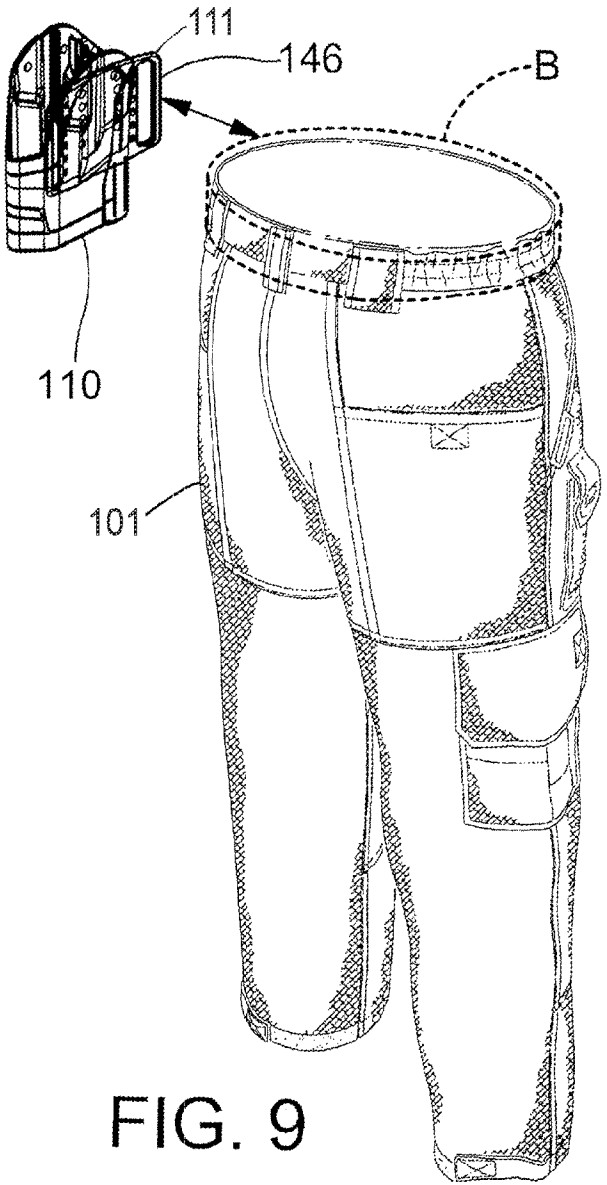
FIG. 9 is a perspective view showing a holster attachable to a user's belt at the user's left side.

Referring to FIGS. 3A-4D, various views of the holster body 110 having passive retention means 110.5 are provided. In embodiments, the holster body 110 has a rearward portion 123 having a shape that is symmetrical about a central plane so that the belt loop 111 is attachable to either a left side 124 or a right side 125 of the holster body 110 and so that the holster 100 is wearable either on the right or left side of a user. In embodiments, the holster body 110 defines a cavity 112 extending forwardly along a handgun receiving and withdrawal axis A1. In embodiments, the holster body 110 has a first body portion 150 defining a first cavity portion 126 and a second body portion 154 defining a second cavity portion 128. In embodiments, the first cavity portion 126 is dimensioned and configured so that, while the handgun 102 is holstered, the first body portion 150 encloses the handgun 102 while leaving a predetermined clearance C around the handgun 102 as best illustrated by FIG. 6. In embodiments, the clearance is selected to allow a single holster system to be utilized with a multiplicity of semi-automatic handguns with mounting rails. In embodiments, the second cavity portion has a shape conforming to the shape of the illuminator 104 whereby the second cavity portion 128 receives the illuminator 104 and engagement with the second body portion 154 precludes movement of the illuminator 104 except for movement in the insertion and the withdrawal directions along a forward rearward axis A2 of the handgun 102. See FIG. 1. The holster body may have a stop portion to stop the insertion motion of a handgun and attached accessory. The stop portion 155 may be configured as a rib and have a stop surface 156 that faces an accessory and attached handgun as it is being holstered.

Referring to FIGS. 3A-4D and 6, in embodiments, the second body portion 154 has a pair of parallel slits 148 defining a leaf spring 158 or a cantilever beam. In embodiments, the leaf spring or beam 158 has a protruding portion 159 extending into the second cavity portion for resiliently engaging the illuminator 104 when the handgun 102 and attached illuminator 104 are holstered. The leaf spring has a first unitary end 165, and an opposite second unitary end 167 with an intermediate portion 169 therebetween. The first and second ends unitary with the rest of the holster body. The protruding portion may comprise a pair of ribs 168 with a inclined lead-in surface 170 for the smooth engagement of the accessory such as the illuminator when inserted. In other embodiments, the two slits may connect at one set of the ends of the slits thereby forming a cantilevered polymer spring, see the dashed lines labeled 171 in FIG. 4B. In embodiments such a spring may perform better than the leaf spring having both end connecting and unitary with the holster body.

Continuing to refer to FIGS. 3A to 4D, in embodiments, the holster body 110 comprises a plurality of side wall portions 180 unitarily formed of a polymeric material. In embodiments, the plurality of side wall portions 180 including a pair of side wall portions 180 unitarily joined at a top or front 182 of the holster body and bottom or backside 184 of the side wall portions 180 (depending on the orientation). In embodiments, each side wall portion has the pair of inwardly projecting ribs 188 configured for capturing and engaging the illuminator 104 when the handgun 102 with illuminator 104 is inserted into the holster 100. In embodiments, the holster and illuminator engagement constrain all freedom of motion of the illuminator 104 except freedom of motion in the insertion and withdrawal direction along a forward rearward axis A2 of the handgun 102 and the axis of the holster body A1.

Referring to FIGS. 5A-5D, the accessory 104, configured as an illuminator in these figures, has a body portion 190 and a rail attachment portion 192 including a clamping portion 193. The clamping portion may be a lever 195 hingedly connected to the body portion by a pin 196 at a proximal end 198 of the lever. A distal end 199 has grasping portion 202 for manually moving the lever. Referring to FIGS. 5A to 7B, an elongate tab 204 positioned intermediate the distal end and the proximal end of the lever 195 projects outwardly to be received in a transverse notch 211 in the handgun accessory rail 106. The lever having a normal position as shown best in FIG. 5B in which the tab is extended outwardly and an inward retracted position as shown by the dashed lines labeled 212. A spring 214 may bias the lever to the normal position. The handgun accessory rail is conventional and may have the dimensions as portrayed in FIG. 7A. The rail has two grooves 213 and two parallel outwardly extending projections 215 each aligned with the axis A2 of the handgun 102. The two parallel outwardly extending projections 215 that receive the cooperating rail attachment portion of the accessory 104. The rail attachment portion 192 of the accessory having two rails 217 with a pair of elongate recesses 219 conforming to the two parallel outwardly extending projections 215 of the accessory rail 106. Each handgun of a multiplicity of handgun will have a conforming accessory rail.

The accessory with the clamp portion as described above may be attached by manually pushing the lever inwardly toward the body portion and engaging the rail attachment portion elongate recesses with the two parallel outwardly extending projections 215. The lever may be released as the accessory is slid along the accessory rail until the tab 204 extends into the transverse groove 211, the action being a snap-on action. In embodiments the rail attachment portion may be slid on the accessory rail without retracting the lever and to 204. Other conventional rail attachment mechanisms may also be suitable in embodiments, for example where the opposing parallel rails with the elongate recesses are tightened toward one another with threaded fasteners.

The accessory, in addition to being an illuminator or flashlight, could be a battery powered laser projecting sight 216, see FIG. 2B. In embodiments, the packaged products may include both an illuminator and a laser sight. Laser sights may use the rail attachment system herein or other rail attachment systems.

In embodiments, the accessory body portion 192 defines a first lateral channel 222 on a first side of the accessory 104 and a second lateral channel 223 on an opposite side of the illuminator 104 for engaging the inwardly projecting ribs 188 of the holster 100. In embodiments, the ribs 188 as part of holster second body portion are adapted and dimensioned to capture and engage the illuminator 104 when the handgun 102 with illuminator 104 is inserted into the holster 100. When an accessory with attached handgun is inserted, the accessory is conformingly and snugly received in the cavity defined by the second body portion. In embodiments, the cavity expands such as by the outward deflection of the spring member Referring to FIG. 1, an upward direction Z and a downward or lower direction −Z are illustrated using arrows labeled "Z" and "−Z," respectively. A forward direction Y and a rearward direction −Y are illustrated using arrows labeled "Y" and "−Y," respectively. A first lateral direction X and a second lateral direct −X are illustrated using arrows labeled "X" and "−X," respectively. The directions illustrated using these arrows are applicable to the apparatus shown and discussed throughout this application. The second lateral direction may also be referred to as a left direction and/or the second lateral direction. The first lateral direction may also be referred to as a right direction. In one or more embodiments, the upward direction is generally opposite the downward direction. In one or more embodiments, the upward direction and the downward direction are both generally orthogonal to an XY plane defined by the forward direction and the first lateral direction. In one or more embodiments, the forward direction is generally opposite the rearward direction. In one or more embodiments, the forward direction and the rearward direction are both generally orthogonal to a ZX plane defined by the upward direction and the first lateral direction. In one or more embodiments, the first lateral direction is generally opposite the second lateral direction. In one or more embodiments, first lateral direction and the second lateral direction are both generally orthogonal to a ZY plane defined by the upward direction and the forward direction. Various direction-indicating terms are used herein as a convenient way to discuss the objects shown in the figures. It will be appreciated that many direction indicating terms are related to the instant orientation of the object being described. It will also be appreciated that the objects described herein may assume various orientations without deviating from the spirit and scope of this detailed description. Accordingly, direction-indicating terms such as "upwardly," "downwardly," "forwardly," "backwardly," should not be interpreted to limit the scope of the invention recited in the attached claims.

Referring to FIGS. 8A-10, an ambidextrous handgun holstering system includes a belt loop 111 and a holster body 110 having a shape in lateral cross-section that is symmetric about an XY plane intersecting a central region of the housing. In embodiments, the holster body 110 is shaped and configured so that a user attachment means, such as a belt engaging member or belt loop 111, may be attached to either of two side wall side portions of the holster body 110 by way of fasteners 121.5. This arrangement may allow the holster to be worn and used by both right-handed users and left-handed users. The belt engaging member or belt loop 111 may receive a belt B.

The following United States patents are hereby incorporated by reference herein: U.S. Pat. Nos. 5,918,784, 6,112,962, 6,267,279, 6,547,111, 6,641,009, 7,937,880, 7,434,712, 7,461,765, 7,556,181, 7,694,860, 7,841,497, 7,954,971, 8,132,355, 8,177,108, U.S. Pat. Nos. 8,235,263, 8,474,670, 8,517,235, 8,690,032, 8,720,755, 8,985,412, 9,057,579, 9,057,580, 9,134,093, 9,759,515, and 9,777,986. Published U.S. Patent Application US2017/0205172 is hereby incorporated by reference herein. All U.S. patents issuing from and claiming priority to U.S. patent application Ser. No. 15/261,079 are hereby incorporated by reference herein.

The above references to U.S. patents in all sections of this application are herein incorporated by references in their entirety for all purposes. Components illustrated in such patents may be utilized with embodiments herein. Incorporation by reference is discussed, for example, in MPEP section 2163.07(B).

The above references in all sections of this application are herein incorporated by references in their entirety for all purposes. All of the features disclosed in this specification (including the references incorporated by reference, including any accompanying claims, abstract and drawings), and/or all of the steps of any method or process so disclosed, may be combined in any combination, except combinations where at least some of such features and/or steps are mutually exclusive.

Each feature disclosed in this specification (including references incorporated by reference, any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any incorporated by reference references, any accompanying claims, abstract and drawings), or to any novel one, or any novel combination, of the steps of any method or process so disclosed. The above references in all sections of this application are herein incorporated by references in their entirety for all purposes.

Although specific examples have been illustrated and described herein, it will be appreciated by those of ordinary skill in the art that any arrangement calculated to achieve the same purpose could be substituted for the specific examples shown. This application is intended to cover adaptations or variations of the present subject matter. Therefore, it is intended that the invention be defined by the attached claims and their legal equivalents, as well as the following illustrative aspects. The above described aspects embodiments of the invention are merely descriptive of its principles and are not to be considered limiting. Further modifications of the invention herein disclosed will occur to those skilled in the respective arts and all such modifications are deemed to be within the scope of the invention.

What is claimed is:

1. A combination handgun holster and illuminator contained within packaging that displays the combination, the holster for receiving each of a multiplicity of handguns having different form factors and each of the multiplicity of handguns having an accessory rail, the illuminator attachable to the accessory rail of each of said multiplicity of handguns;

the holster comprising a holster body and a belt loop, the holster body and belt loop being disposed in the interior of the package, the holster body having rearward portion having a shape that is symmetrical about a central plane and belt loop attachment portions on each of a left side and a right side of the rearward portion where by the belt loop is attachable to either the left side or the right side of the holster body with a pair of threaded fasteners included in the packaging, whereby the holster is wearable either on the right or left side of a user;

the holster body defining a cavity extending along a handgun receiving and withdrawal axis, the holster body having a first body portion defining a first cavity portion and a second body portion defining a second cavity portion, the first cavity portion being dimensioned and configured so that, while the handgun is holstered there is a clearance between the handgun and holster extending around three sides of the handgun, wherein the first internal cavity is defined by opposing parallel planar faces of opposing lateral holster body sidewalls;

the second cavity portion having a shape conforming to the shape of the illuminator whereby the second cavity portion receives the illuminator and engagement of the illuminator with the second body portion precludes movement of the illuminator except for movement in the insertion and withdrawal direction along an illuminator receiving and withdrawal axis parallel to the handgun receiving and withdrawal axis, the second body portion having a pair of parallel through slits disposed in a lateral sidewall of the second body portion defining a unitary retention portion configured as a polymer spring, the polymer spring having a protruding portion disposed between the pair of parallel through slits and extending into the second cavity portion for resiliently engaging the illuminator when the handgun and illuminator are holstered thereby clamping the accessory between the opposing sides of the holster body;

the illuminator having a body and a rail attachment portion including a clamp portion for securing the illuminator to the accessory rail without using threaded fasteners, the body defining a battery receiving cavity, a battery included in the packaging; and the packaging being configured such that the holster body and illuminator are visible through the packaging.

2. The combination of claim 1, wherein the clamp portion of the illuminator comprises a snap-on rail attachment mechanism.

3. The combination of claim 2, wherein the accessory rail comprises two parallel grooves aligned with an axis of the handgun, and wherein the rail attachment portion includes two opposing elongate groove engagement portions each having in cross-section a V-shaped groove engagement surface, the elongate groove engagement portions unitary with the illuminator body.

4. The combination of claim 1, wherein each of the accessory rails of the multiplicity of handguns to which the illuminator is attachable has a transverse notch on the respective accessory rail, and wherein the illuminator clamp portion comprises a spring loaded lever arm with a proximal end pivotally attached to a body of the illuminator, a distal end with a manual grasping portion, and an elongate tab positioned intermediate the distal end and the proximal end and sized for being received in the transverse notch on the accessory rail, the lever arm movable between an outwardly attachment position wherein the elongate tab is positioned for being received in the notch locking the illuminator into position and an inward release position wherein the illuminator is slidable along accessory rails of handguns for attachment and removal of the illuminator to the respective handguns.

5. The combination of claim 1, wherein the unitary retention portion has a first unitary end and a second unitary end and an intermediate portion extending between the first end unitary with the holster body defining a retention beam portion, the retention beam portion having a pair of ribs oriented with the handgun receiving and withdrawal axis and having an arcuate inwardly facing surfaces for engagement of the accessory while the accessory and attached handgun is being received and seated in the holster, the intermediate portion moving outwardly as the accessory with attached handgun is being received and seated, the inwardly protruding portion being disposed between the first end and the second end, the retention beam portion bending in a bow-like manner while the accessory is received in the cavity.

6. The combination of claim 1, wherein the body of the illuminator is metal and the holster body is unitarily formed of a single piece of glass filled polyamide material whereby when the illuminator is attached to the handgun, a smooth and soft feel engagement of the illuminator with the attached handgun and the holster body is provided when said illuminator with attached handgun are received by the holster.

7. The combination of claim 1 wherein the first internal cavity is defined by opposing parallel planar faces of opposing lateral holster body sidewalls, wherein the width of the internal cavity spaced 0.25 inches from the forward margin of the holster body is about 1.20 inches to about 1.50 inches.

8. The combination of claim 1, further in combination with the handgun attached to the accessory.

9. A combination handgun holster and illuminator in packaging that displays the combination, the holster for receiving each of a multiplicity of handguns having different form factors and each of the multiplicity of handguns having an accessory rail, the illuminator attachable to the accessory rail of the handgun;

the holster comprising a holster body and a belt loop, the holster body and belt loop being disposed in the interior of the package, the holster body having rearward portion having a shape that is symmetrical about a central plane and belt loop attachment portions on each of a left side and a right side of the rearward portion whereby the belt loop is attachable to either the left side or the right side of the holster body, whereby the holster is wearable either on the right or left side of a user; the holster body defining a cavity sized for receiving each of the multiplicity of handguns with a clearance between each of the multiplicity of handguns and the holster body;

the holster body defining a cavity extending along a handgun receiving and withdrawal axis, the holster body having a first body portion defining a first cavity portion and a second body portion defining a second cavity portion, the first cavity portion being dimensioned and configured so that, when the handgun is attached to the illuminator and the handgun is holstered, there is a clearance around the handgun; the first cavity being dimensioned so that the holster body may be utilized with the multiplicity of handguns comprising semi-automatic handguns with mounting rails;

the holster only having passive retention of the accessory and attached handgun, the second body portion defining a second cavity portion having a shape and internal width dimension and the illuminator having a shape and external width dimension such that the second body portion interferes with the illuminator when the illuminator is attached to the handgun and the illuminator with attached handgun is inserted into the second cavity portion, whereby when the second body portion receives the illuminator and attached handgun there is an expansion of the internal width dimension of the second cavity portion such that the second body portion conformingly and snugly receives the illuminator, and the engagement of the illuminator with the second body portion precludes movement of the illuminator and attached handgun except for movement in the insertion and withdrawal direction along an illuminator receiving and withdrawal axis parallel to the handgun receiving and withdrawal axis;

the second body portion having a pair of parallel through slits disposed in a lateral sidewall of the second body portion defining a unitary retention portion configured as a polymer spring, the polymer spring having a protruding portion disposed between the pair of parallel through slits and extending into the second cavity portion for resiliently engaging the illuminator when the handgun and illuminator are holstered thereby clamping the accessory between the opposing sides of the holster body;

the illuminator having a body and a rail attachment portion including a clamp portion for securing the illuminator to the accessory rail; and the packaging having a transparent portion with the holster body and illuminator visible therethrough.

10. The combination of claim 9, wherein the body of the illuminator is metal and the holster body is unitarily formed of a single piece of glass filled polyamide material whereby when the illuminator is attached to the handgun, a smooth and soft feel engagement of the illuminator with the attached handgun and the holster body is provided when said illuminator with attached handgun are received by the holster.

11. The combination of claim 9; whereby when the illuminator is attached to the handgun and the illuminator and attached handgun are holstered, the polymer spring is pushed outwardly thereby expanding the width of the second cavity and thereby clamping the accessory between the opposing sides of the holster body.

12. The combination of claim 11, wherein the polymer spring has two unitary ends and an intermediate portion therebetween, the protruding portion configured as a rib with an inclined lead-in surface.

13. The combination of claim 9, wherein accessory rails of handguns to which the illuminator is attachable have a transverse notch, and wherein the illuminator clamp portion comprises a spring loaded lever arm with a proximal end pivotally attached to a body of the illuminator, a distal end with a manual grasping portion, and an elongate tab positioned intermediate the distal end and the proximal end and sized for being received in the transverse notch, the lever arm movable between an outwardly attachment position wherein the elongate tab is positioned for being received in the notch locking the illuminator into position and an inward release position wherein the illuminator is slidable along accessory rails of handguns for attachment and removal of the illuminator to the respective handguns.

14. The combination of claim 9, wherein the packaging comprises a six sided box package having an interior with a volume of about 90 cu. in. to about 104 cu. in, the box having a front panel, a top panel, a bottom panel, a rearward panel, and a pair of lateral panels, wherein the package has graphics on at least one of the front panel and the pair of lateral panels, the front panel defining an opening with transparent sheet material spanning the opening, the holster body and illuminator are visible through the transparent sheet material.

15. The combination of claim 14, further comprising a laser sight contained in the package and visible through the transparent sheet material.

16. The combination of claim 14, further comprising threaded fasteners for securing the belt loop to either side of the holster body, a battery for the illuminator, and paper with instructions thereon, all contained within the packaging.

17. A combination handgun holster and battery powered rail mountable light generating accessory contained in packaging, the holster having a holster body sized for receiving each of a multiplicity of handguns having different form factors and each of the multiplicity of handguns having an accessory rail, the illuminator attachable to the accessory rail of each of the multiplicity of handguns;

the holster comprising the holster body and a belt loop attachable to either of two lateral sides of the holster body with a pair of threaded fasteners, the pair of threaded fastener included in the packaging, whereby the holster is wearable either on the right or left side of a user; the holster body defining a cavity sized for receiving each of the multiplicity of handguns with spacing between each of the multiplicity of handguns and the holster body;

the holster body defining a cavity extending along a handgun receiving and withdrawal axis, the holster body having a first body portion defining a first cavity portion and a second body portion defining a second cavity portion, the first cavity portion being dimensioned and configured so that, while the handgun is holstered, the first body portion receives the handgun while leaving a clearance around the handgun; the clearance being selected to allow the holster body to receive each of the multiplicity of handguns comprising semi-automatic handguns with mounting rails;

the holster only having passive retention of the accessory and the attached handgun, the second body portion defining a second cavity portion having a shape and internal width dimension and the accessory having a shape and external width dimension such that the second body portion interferes with the accessory when the accessory is attached to the handgun and the accessory with attached handgun is inserted into the second cavity portion, the second body portion having a pair of through slits disposed in a lateral sidewall of the second body portion and defining a unitary polymer spring, the polymer spring having a protruding portion disposed between the parallel through slits extending into the second cavity portion and defining a measurement point for the internal width dimension, the polymer spring for resiliently engaging the accessory whereby when the accessory is attached to the handgun and the accessory and attached handgun are holstered the polymer spring is pushed outwardly thereby expanding the width of the second cavity and thereby clamping the accessory between the opposing sides of the holster body;

the accessory having a body and a rail attachment portion including a clamp portion for securing the accessory to the accessory rail, the body defining a battery receiving cavity, a battery included in the packaging;

paper instructions relating to attachment of the belt loop to the holster and attachment of the accessory to an accessory rail included with the packaging;

wherein the packaging being configured such that the holster body and accessory are visible through the packaging.

18. The combination of claim 17, wherein the accessory is a flashlight and the clamp portion attachable to an accessory rail without utilizing thread fasteners.

19. The combination of claim 17, further comprising a laser sight included in the packaging, the laser sight having a clamp portion utilizing threaded fasteners.

* * * * *